US005193140A

United States Patent [19]

Minde

[11] Patent Number: 5,193,140

[45] Date of Patent: Mar. 9, 1993

[54] EXCITATION PULSE POSITIONING METHOD IN A LINEAR PREDICTIVE SPEECH CODER

[75] Inventor: Tor B. Minde, Lulea, Sweden

[73] Assignee: Telefonaktiebolaget L M Ericsson, Stockholm, Sweden

[21] Appl. No.: 501,767

[22] Filed: Mar. 30, 1990

[30] Foreign Application Priority Data

May 11, 1989 [SE] Sweden ..... 8901697

[51] Int. Cl.[5] ..... G10L 9/14

[52] U.S. Cl. ..... 395/2; 381/38

[58] Field of Search ..... 381/29–41; 364/513.5

[56] References Cited

U.S. PATENT DOCUMENTS

| | | | |
|---|---|---|---|
| 4,472,832 | 9/1984 | Atal et al. | 381/40 |
| 4,736,428 | 4/1988 | Deprettere et al. | 381/38 |
| 4,847,905 | 7/1989 | Lefevre et al. | 381/36 |
| 4,864,621 | 9/1989 | Boyd | 381/38 |
| 4,944,013 | 7/1990 | Gouvianakis et al. | 381/38 |
| 4,945,565 | 7/1990 | Ozawa et al. | 381/38 |

FOREIGN PATENT DOCUMENTS

| | | |
|---|---|---|
| 0195487 | 9/1986 | European Pat. Off. . |
| 2173679 | 10/1986 | United Kingdom . |

OTHER PUBLICATIONS

"Generalization of the Multipulse Coding for Low Bit Rate Coding Purposes: The Generalized Decimation", ICASSP 85, IEEE International Conference on Acoustics, Speech, and Signal Processing, Mar. 1985, vol. 1, pp. 256–259, Adoul et al.

"A Regular-Pulse Excited Linear Predictive Codec", Speech Communication, vol. 7, No. 2, Jul. 1988, pp. 209–215, Vary et al.

*Primary Examiner*—Michael R. Fleming
*Assistant Examiner*—Michelle Doerrler
*Attorney, Agent, or Firm*—Burns, Doane, Swecker & Mathis

[57] ABSTRACT

A method for positioning excitation pulses for a linear predictive coder (LPC) operating according to the multi-pulse principle, i.e. a number of such pulses are positioned at specific time points and with specific amplitudes. The time points and the amplitudes are determined from the predictive parameters ($a_k$) and the predictive residue signal ($d_k$), by correlation between a speech representative signal (y) and a composed synthesized signal ($\hat{y}$). All possible time positions for the excitation pulses within a given frame interval are provided. The possible time positions are divided into a number ($n_f$) of phase positions and each phase position is divided into a number of phases (f). All phases are vacant for the first excitation pulse. When this pulse has been positioned, the phase determined for this pulse is denied to the following excitation pulses until all pulses in a frame have been positioned.

4 Claims, 5 Drawing Sheets

N=24 F=4 NF=6
p=1
0 1 2 3 4 5 6 7 8 9 10 11 12 13 14 15 16 17 18 19 20 21 22 23
nf=0 nf=1 nf=2 nf=3 nf=4 nf=5 p=2
0 1 2 3 4 5 6 7 8 9 10 11 12 13 14 15 16 17 18 19 20 21 22 23 p=3
0 1 2 3 4 5 6 7 8 9 10 11 12 13 14 15 16 17 18 19 20 21 22 23 p=4
0 1 2 3 4 5 6 7 8 9 10 11 12 13 14 15 16 17 18 19 20 21 22 23

Am1
m2
EXC. PULSES
m1
Am2
TIME

N=25 F=5 NF=5
p=1
0 1 2 3 4 5 6 7 8 9 10 11 12 13 14 15 16 17 18 19 20 21 22 23 24
nf=0 nf=1 nf=2 nf=3 nf=4 p=2
0 1 2 3 4 5 6 7 8 9 10 11 12 13 14 15 16 17 18 19 20 21 22 23 24 p=3
0 1 2 3 4 5 6 7 8 9 10 11 12 13 14 15 16 17 18 19 20 21 22 23 24 p=4
0 1 2 3 4 5 6 7 8 9 10 11 12 13 14 15 16 17 18 19 20 21 22 23 24 p=5
0 1 2 3 4 5 6 7 8 9 10 11 12 13 14 15 16 17 18 19 20 21 22 23 24

Am1
m2
EXC. PULSES
m1
Am2
TIME

EXCITATION PULSE POSITIONING METHOD IN A LINEAR PREDICTIVE SPEECH CODER

FIELD OF THE INVENTION

The present invention relates to a method of positioning excitation pulses in a linear predictive speech coder which operates according to the multi-pulse principle. Such a speech coder may be incorporated, for instance, in a mobile telephone system, for the purpose of compressing speech signals prior to transmission from a mobile.

BACKGROUND OF THE INVENTION

Linear predictive speech coders which operate according to the aforesaid multi-pulse principle are known to the art, from, for instance, U.S. Pat. No. 3,624,302, which describes linear predictive coding (LPC) of speech signals, and also from U.S. Pat. No. 3,740,476 which teaches how predictive parameters and predictive residue signals can be formed in such a speech coder.

When forming an artifical speech signal by means of linear predictive coding, there is generated from the original signal a number of predictive parameters ($a_k$) which characterize the synthesized speech signal. Thus, there can be formed with the aid of these parameters a speech signal which will not include the redundancy which is normally found in natural speech and the conversion of which is unnecessary when transmitting speech between, for instance, a mobile and a base station included in a mobile radio system. From the standpoint of conserving bandwidth, it is more appropriate to transfer solely predictive parameters instead of the original speech signal, which requires a much wider bandwidth. The speech signal regenerated in a receiver and constituting a synthetic speech signal can, however, be difficult to comprehend, due to a lack of agreement between the speech pattern of the original signal and the synthetic signal recreated with the aid of the prediction parameters. These deficiencies have been described in detail in U.S. Pat. No. 4,472,832 (SE-A--456618) and can be alleviated to some extent by the introduction of so-called excitation pulses (multi-pulses) when forming the synthetic speech copy. In this case, the original speech input pattern is divided into frame intervals. Within each such interval there is formed a given number of pulses of varying amplitude and phase position (time position), on the one hand in dependence on the prediction parameters $a_k$, and on the other hand in dependence on the predictive residue $d_k$ between the speech input pattern and the speech copy. Each of the pulses is permitted to influence the speech pattern copy, so that the predictive residue will be as small as possible. The excitation pulses generated have a relatively low bit-rate and can therefore be coded and transmitted in a narrow band, as can also the prediction parameters. This results in an improvement in the quality of the regenerated speech signal.

In the case of the aforesaid known methods, the excitation pulses are generated within each frame interval of the speech input pattern, by weighting the residue signal $d_k$ and by feeding-back and weighting the generated values of the excitation pulses, each in a separate predictive filter. The output signals from the two filters are then correlated. This is followed by maximization of the correlation of a number of signal elements from the correlated signal, therewith forming the parameters (amplitude and phase position) of the excitation pulses. The advantage of this multi-pulse algorithm for generating excitation pulses is that various types of sound can be generated with a small number of pulses (e.g. 8 pulses per frame interval). The pulse searching algorithm is general with respect to the positioning of pulses in the frame. It is possible to recreate non-accentuated sounds (consonants), which normally require randomly positioned pulses, and accentuated sounds (vowels), which require more collected positioning of the pulses.

One drawback with the known pulse positioning method is that the coding effected subsequent to defining the pulse positions is complex with respect to both calculation and storage. Furthermore, the method requires a large number of bits for each pulse position in the frame interval. The bits in the code words obtained from the optimal combinatory pulse-coding algorithms are also prone to bit-error. A bit-error in the code word being transmitted from transmitter to receiver can have a disastrous consequence with regard to pulse positioning when decoding the code word in the receiver.

SUMMARY OF THE INVENTION

The present invention is based on the fact that the number of pulse positions for the excitation pulses within a frame interval is so large as to make it possible to forego exact positioning of one or more excitation pulses within the frame and still obtain a regenerated speech signal of acceptable quality subsequent to coding and transmission.

According to the known methods, the correct phase positions are calculated for the excitation pulses within one frame and following frames of the speech signal and positioning of the pulses is effected solely in dependence on complex processing of speech signal parameters (predictive residue, residue signal and the parameters of the excitation pulses in preceding frames).

According to the present inventive method, certain phase position limitations are introduced when positioning the pulses, by denying a given number of previously determined phase positions to those pulses which follow the phase position of an excitation pulse that has already been calculated. Subsequent to calculating the phase position of a first pulse within the frame and subsequent to placing this pulse in the calculated phase position, that phase position is denied to following pulses within the frame. This rule preferably applies to all pulse positions in the frame.

Accordingly, the object of the present invention is to provide a method for determining the positions of the excitation pulses within a frame interval and following frame intervals of a speech-input pattern to a linear predictive coder which requires a less complex coder and a smaller bandwidth and which will reduce the risk of bit-error in the subsequent recoding prior to transmission.

The proposed method may be applied with a speech coder which operates according to the multi-pulse principle with correlation of an original speech signal and the impulse response of an LPC-synthesized signal. The method can also be applied, however, with a so-called RPE-speech coder in which several excitation pulses are positioned in the frame interval simultaneously.

BRIEF DESCRIPTION OF DRAWINGS

The proposed method will now be described in more detail with reference to the accompanying drawings, in which.

DETAILED DESCRIPTION OF THE PREFERRED EMBODIMENTS

Figure 1:
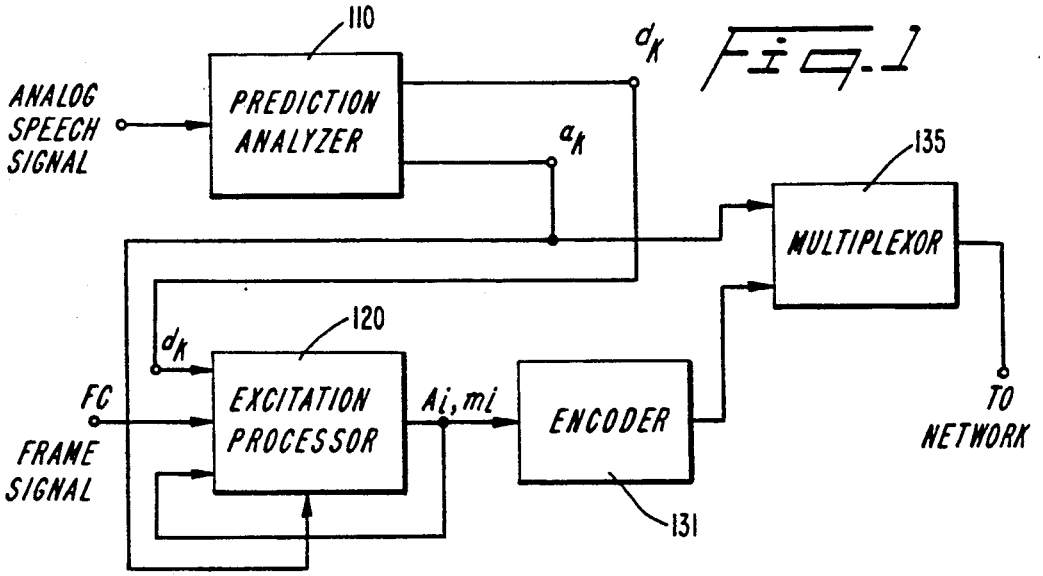
FIG. 1 is a simplified block schematic of a known LPC-speech-coder.

FIG. 1 is a simplified block schematic of a known LPC-speech-coder which operates according to the multi-pulse principle. One such coder is described in detail in U.S. Pat. No. 4,472,832 (SE-A-456618). An analogue speech signal from, for instance, a microphone occurs on the input of a prediction analyzer 110. In addition to an analogue-digital converter, the prediction analyzer 110 also includes an LPC-computer and a residue-signal generator, which form prediction parameters $a_k$ and a residue-signal $d_k$ respectively. The prediction parameters characterize the synthesized signal, whereas the residue signal shows the error between the synthesized signal and the original speech signal across the input of the analyzer.

An excitation processor 120 receives the two signals $a_k$ and $d_k$ and operates under one of a number of mutually sequential frame intervals determined by the frame signal FC, such as to emit a given number of excitation pulses during each of said intervals. Each of said pulses is determined by its amplitude $A_{mp}$ and its time position, $m_p$ within the frame. The excitation-pulse parameters $A_{mp}$, $m_p$ are led to an encoder 131 and are thereafter multiplexed in a multiplexer 135 with the prediction parameters $a_k$, prior to transmission from a radio transmitter for instance.

The excitation processor 120 includes two predictive filters having the same impulse response for weighting the signals $d_k$ and $A_i$, $m_i$ in dependence on the prediction parameters $a_k$ during a given computing or calculating stage p. Also included is a correlation signal generator which operates in each modification stage to effect correlation between the weighted original signal (y) and the weighted synthesized signal ($\hat{Y}$) each time an excitation pulse is to be generated. For each correlation there is obtained a number q of "candidates" of pulse elements $A_i$, $m_i$ ($0 \leqq i < I$), of which one candidate gives the smallest quadratic error or smallest absolute value. The amplitude $A_{mp}$ and time position $m_p$ for the selected "candidate" are calculated in the excitation signal generator. The contribution from the selected pulse $A_{mp}$, $m_p$ is then subtracted from the desired signal in the correlation signal generator, so as to obtain a new sequence of "candidates", and the method is repeated for a number of times which equals the desired number of excitation pulses within a frame. This is described in detail in the aforesaid US-patent specification.

Figure 2A:
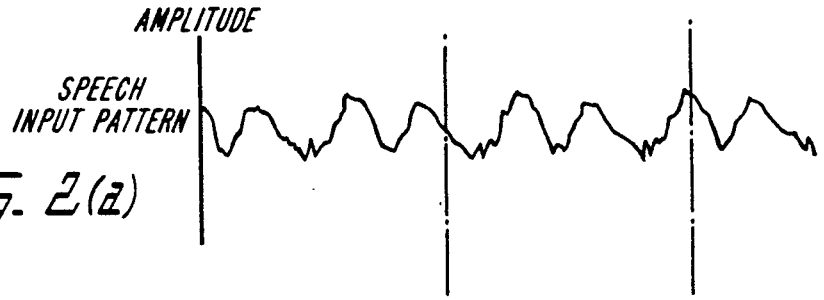
FIGS. 2(a)–2(c) are time diagrams which cover certain signals occurring in the speech coder according to FIG. 1.
Figure 2B:
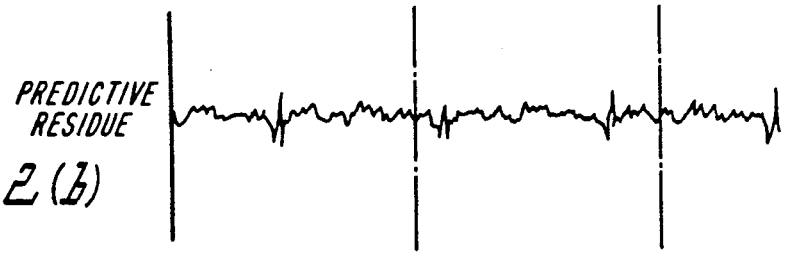
Figure 2C:
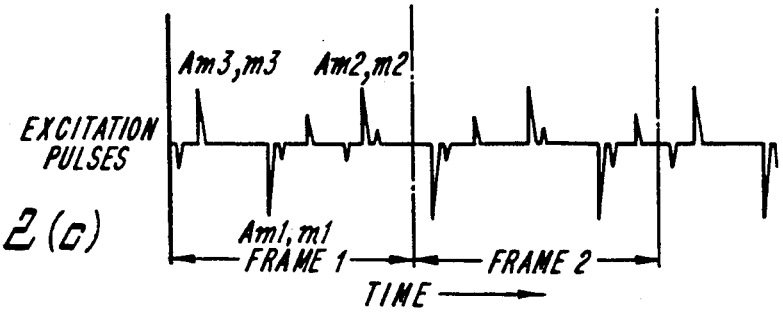

FIGS. 2(a)–2(c) are time diagrams over speech input signals, predictive residues $d_k$ and excitation pulses, respectively. The number of excitation pulses in this example is eight (8), of which the pulse $A_{m1}$, $m_1$ was selected first (gave the smallest error), and thereafter pulse $A_{m2}$, $m_2$, etc. within the frame.

In the earlier known method for calculating amplitude $A_i$ and phase position $m_i$ for each excitation pulse, $m_i = m_p$ is calculated for that pulse which gave maximum value of $\alpha i/\phi ij$, and associated amplitude $A_{mp}$ was calculated, where $\alpha m$ is the cross-correlation vector between the signals $y_n$ and $\hat{y}_n$ according to the above, and $\phi mm$ is the auto-correlation matrix for the impulse response of the prediction filters. Any position $m_p$ whatsoever is accepted when solely the above conditions are fulfilled. The index p signifies the stage under which calculation of an excitation pulse according to the above takes place.

Figure 3:
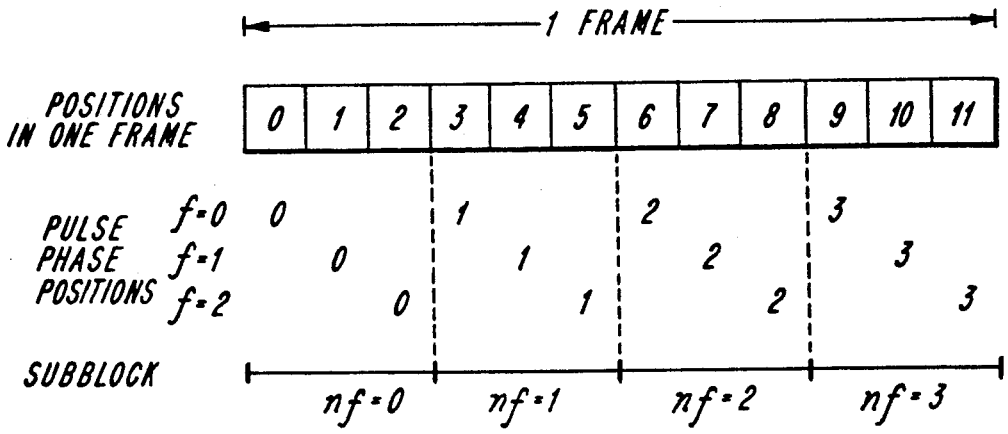
FIG. 3 is a diagram explaining the principle of the invention.

In accordance with the invention, a frame according to FIG. 2 is divided in the manner illustrated in FIG. 3. It is assumed, by way of example, that the frame contains N=12 positions. In this case, the N-positions form a search vector (n). The whole of the frame is divided into so-called sub-blocks. Each sub-block will then contain a given number of phases. For instance, if the whole frame contains N=12 positions, in accordance with FIG. 3, four sub-blocks are obtained and each sub-block will contain three different phases. Each sub-block has a given position within the full frame, this position being referred to as the phase position. Each position $n(0 \leqq n < N)$ will then belong to a given sub-block $n_f$ $(0 \leqq n_f < N_f)$ and a given phase f $(0 \leqq f < F)$ in said sub-block.

In general the positions n $(0 \leqq n < N)$ in the total search vector, which contains N positions, will be $$n = n_f F + f$$

$n_f = 0, \ldots,$
$(N_f - 1),$
$f = 0, \ldots (F-1)$ and
$n = 0, \ldots, (N-1).$ Furthermore, the following relationship will also apply $$f = n \text{ MOD } F \text{ and } n_f = n \text{ DIV } F \quad (1)$$

The diagram of FIG. 3 illustrates the distribution of the phases f and sub-blocks $n_f$ for a given search vector containing N positions. In this case, N=12, F=3 and $N_F = 4$.

The inventive method implies limiting the pulse search to positions which do not belong to an occupied phase $f_p$ for those excitation pulses whose positions n have been calculated in preceding stages.

In the following, the order or sequence number of a given calculating cycle of an excitation pulse is designated p, in accordance with the aforegoing. The proposed method will then result in the following calculation stages for a frame interval:

1. Calculate the desired signal $Y_n$
2. Calculate the cross-correlation vector $\alpha_i$
3. Calculate the auto-correlation matrix $\phi_{ij}$
4. When p=1. Search for $m_p$, i.e. the pulse position which gives maximum $\alpha_i/\phi_{ij} = \alpha_m/\phi mm$ in the unoccupied phases f.
5. Calculate the amplitude $A_{mp}$ for the discovered pulse position $m_p$.
6. Update the cross-correlation vector $\alpha_i$.

7. Calculate $f_p$ and $n_{fp}$ in accordance with the relationship (1) above, and
8. Carry out steps 4–7 above when $p=p+1$.

Figures 4A, 4B, 4C, 4D, 4E, 4F, 4G, 4H, 4I, 4J, 4K:
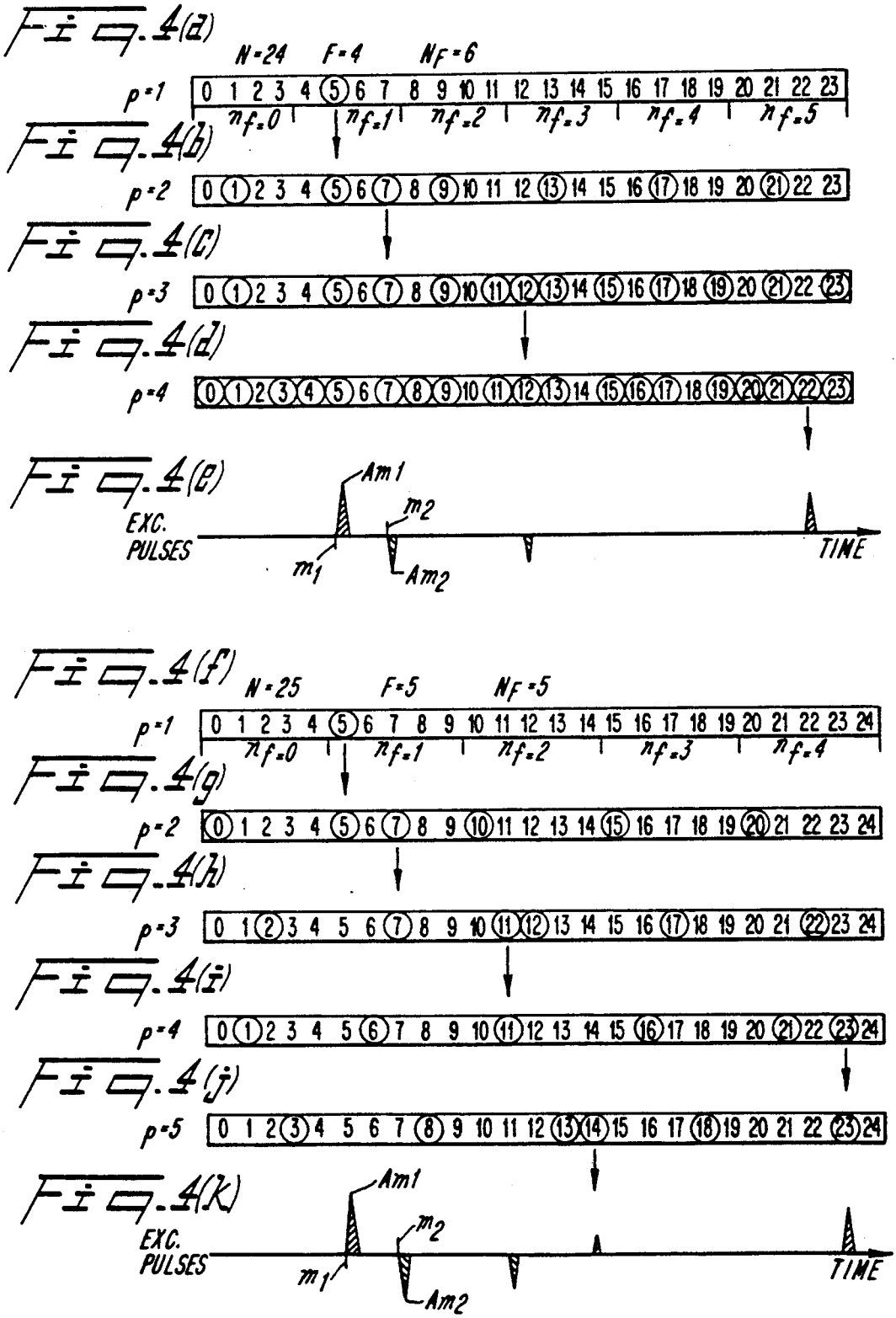
FIGS. 4(a)–4(k) are more detailed diagrams illustrating the principle of the invention.

FIGS. 4(*a*)–4(*k*) are diagrams which illustrate a method for implementing the present invention.

FIG. 4(*a*)–4(*e*) illustrate an example in which the number of positions in a frame are $N=24$, the number of phases are $F=4$ and the number of phase positions are $N_F=6$.

It is assumed that no phases are occupied at the start $p=1$, and it is also assumed that the above calculating stages 1–4 gave the position $m_l=5$. This pulse position is marked with a circle in FIG. 4(*a*). This gives the phase 1 in respective phase positions $n_f=0,1,2,3,4$ and 5, and corresponding pulse positions are $n=1$, 5, 9, 13, 17 and 21 in accordance with the relationship (1) above. The phase 1 and corresponding pulse positions are thus occupied when calculating the position of the next excitation pulse ($p=2$). It is assumed that the calculating stage 4 for $p=2$ results in $m_2=7$. Possibly $m_2=9$ can have the maximum value of $\alpha_i/\phi_{ij}$, but this selection results in an occupied phase. The pulse position $m_2=7$ gives phase 3 in each of the phase positions $n_f=0, \ldots 5$, and means that the pulse positions $n=3,7,11,15$ and 22 will be occupied. The positions 1,3,5,7,9,11,13,15,17,19,21 and 23 are thus occupied before commencement of the next calculating stage ($p=3$).

It is assumed that the calculating stages 1–4 above for $p=3$ will give $m_3=12$, and that for $p=4$ the calculating stages result in the last position $m_4=22$. All positions in the frame are herewith occupied. FIG. 4(*e*) illustrates the excitation pulses ($A_{ml}$, $m_l$), ($A_{m2}$, $m_2$) etc., obtained.

FIGS. 4(*f*)–4(*k*) illustrates a further example, in which $N=25$, $F=5$ and $N_F=5$, i.e. the number of phases within each phase position has been increased by one. Pulse positioning is effected in the same manner as that according to FIGS. 4(*a*)–4(*e*) and finally five excitation pulses are obtained. The maximum number of excitation pulses obtained is thus equal to the number of phases within one phase position.

The obtained phases $f_l, .., f_p$ ($p=4$ in FIGS. 4(*a*)–4(*e*) and $p=5$ in FIGS. 4(*f*)–4(*h*) are coded together and the resultant phase positions $n_{fl}, \ldots, n_{fp}$ are each coded per se prior to transmission. Combinatory coding can be employed for coding the phases. Each of the phase positions is coded with a code word per se.

Figure 5:
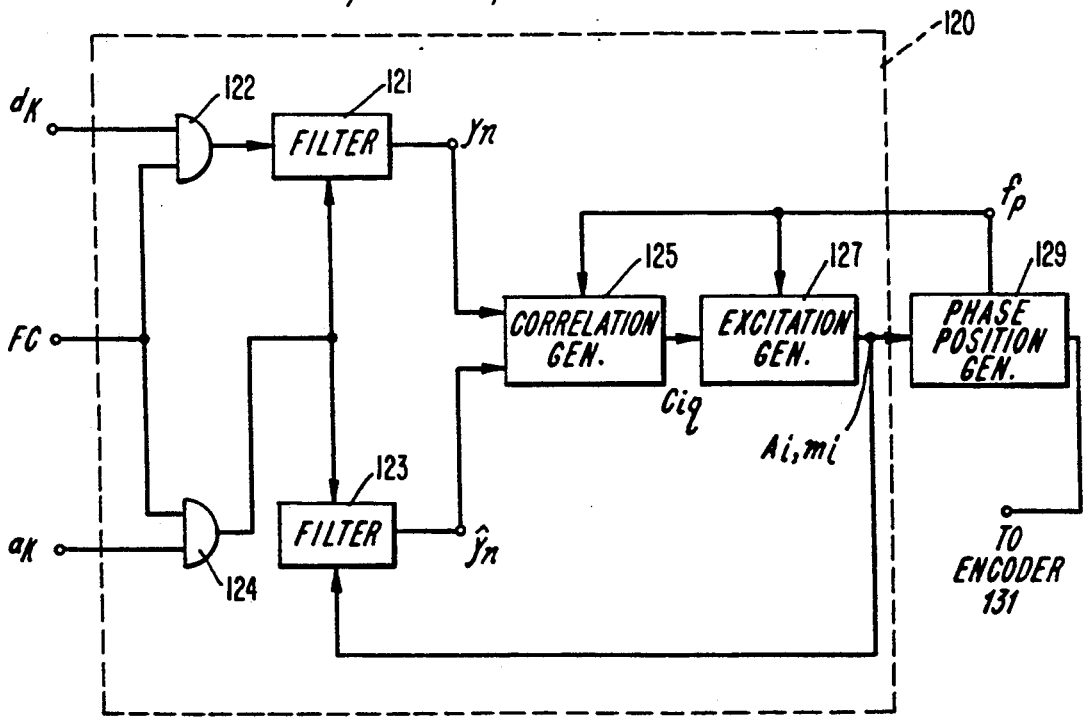
FIG. 5 is a block schematic illustrating a part of a speech coder which operates in accordance with the inventive principle.

In accordance with one embodiment, the known speech-processor circuit can be modified in the manner illustrated in FIG. 5, which illustrates that part of the speech processor which includes the excitation-signal generating circuits 120.

Each of the predictive residue-signals $d_k$ and the excitation generator 127 are applied to a respective filter 121 and 123 in time with a frame signal FC, via the gates 122, 124. The filters 121, 123 produce the signals $y_n$ and $\hat{y}_n$ which are correlated in the correlation generator 125. The signal $y_n$ represents the true speech signal, whereas $\hat{y}_n$ represents the synthesized speech signal. There is obtained from the correlation generator 125 a signal $C_{iq}$ which includes the components $\alpha_i$ and $\phi_{ij}$ in accordance with the aforegoing. A calculation is made in the excitation generator 127 of the pulse position $m_p$ which gives maximum $\alpha_i/\phi_{ij}$, wherein the amplitude $A_{mp}$ according to the aforegoing is obtained in addition to the pulse position $m_p$.

The excitation pulse parameters $m_p$, $A_{mp}$ produced by the excitation generator 127 are sent to a phase generator 129. This generator calculates the current phases $f_p$ and the phase positions $n_{fp}$ from the values $m_p$, $A_{mp}$ arriving from the excitation generator 127, in accordance with the relationship $$f=(m-1) \text{ MOD } F+1$$

$$n_f=(m-1) \text{ DIV } F+1$$

where $F$=the number of possible phases.

The phase generator 129 may consist of a processor which includes a read memory operative to store instructions for calculating the phases and the phase positions in accordance with the above relationship.

Phase and phase position are then supplied to the encoder 131. This coder is of the same principle construction as the known coder, but is operative to code phase and phase position instead of the pulse positions $m_p$. On the receiver side, the phases and phase positions are decoded and the decoder thereafter calculates the pulse position $m_p$ in accordance with the relationship $$m_p=(n_{fp}-1)\cdot F+f_p$$

which gives a clear determination of the excitation-pulse position.

The phase $f_p$ is also supplied to the correlation generator 125 and to the excitation generator 127. The correlation generator stores this phase and takes into account that this phase $f_p$ is occupied. No values of the signal $C_{iq}$ are calculated where q is included in those positions which belong to all preceding $f_p$ calculated for an analyzed sequence. The occupied positions are $$q=n\cdot F+f_p$$

where $n=0, \ldots, (N_f-1)$ and $f_p$ signifies all preceding phases occupied within a frame. Similarly, the excitation generator 127 takes into account the occupied phases when making a comparison between the signals $C_{iq}$ and $C_{iq}^*$.

When all pulse positions in respect of one frame have been calculated and processed and when the next frame is to be commenced, all phases will, of course, again be vacant for the first pulse in the new frame.

Figure 6A:
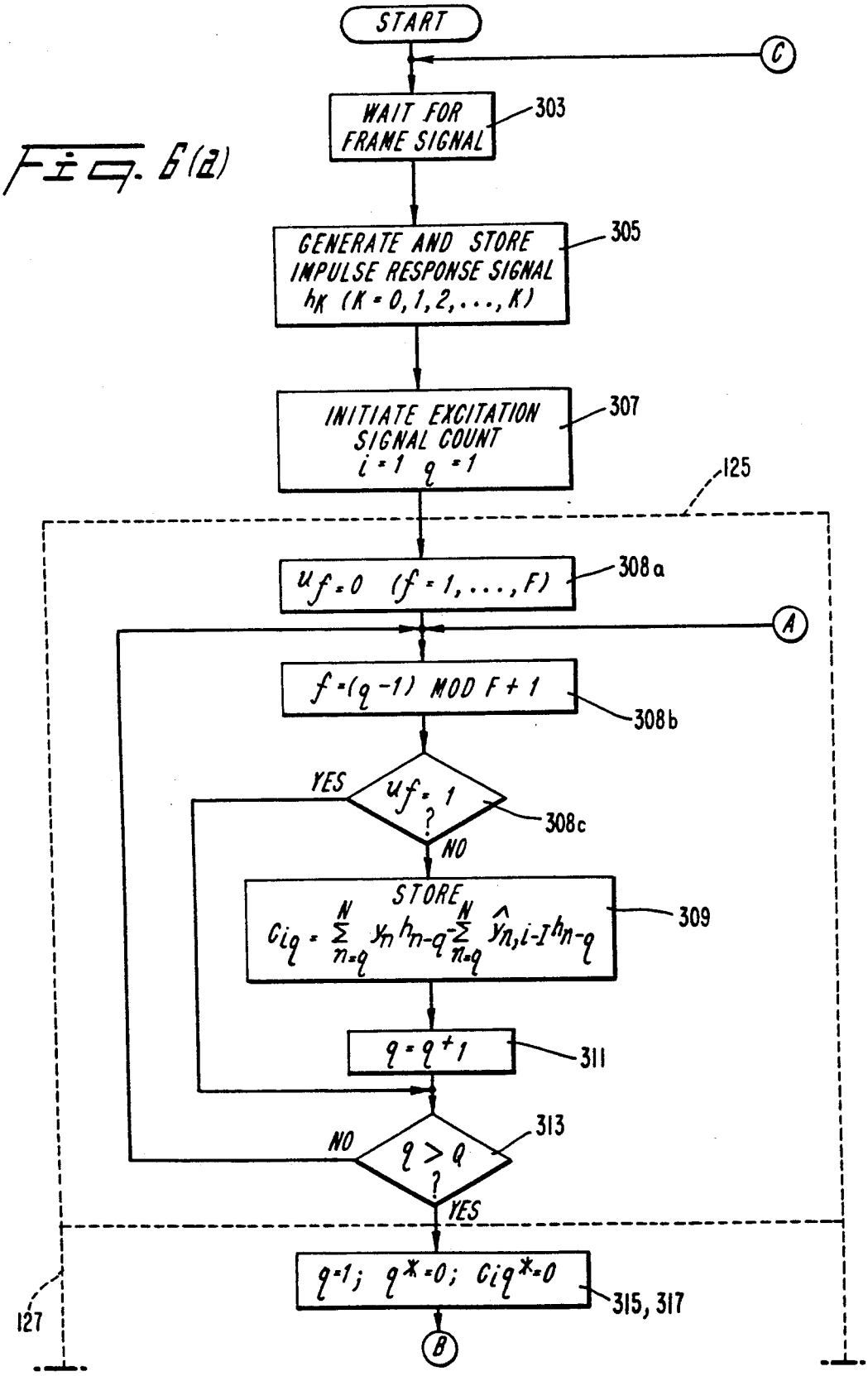
FIGS. 6(a)–6(b) are flow charts for the speech coder shown in FIG. 5.
Figure 6B:
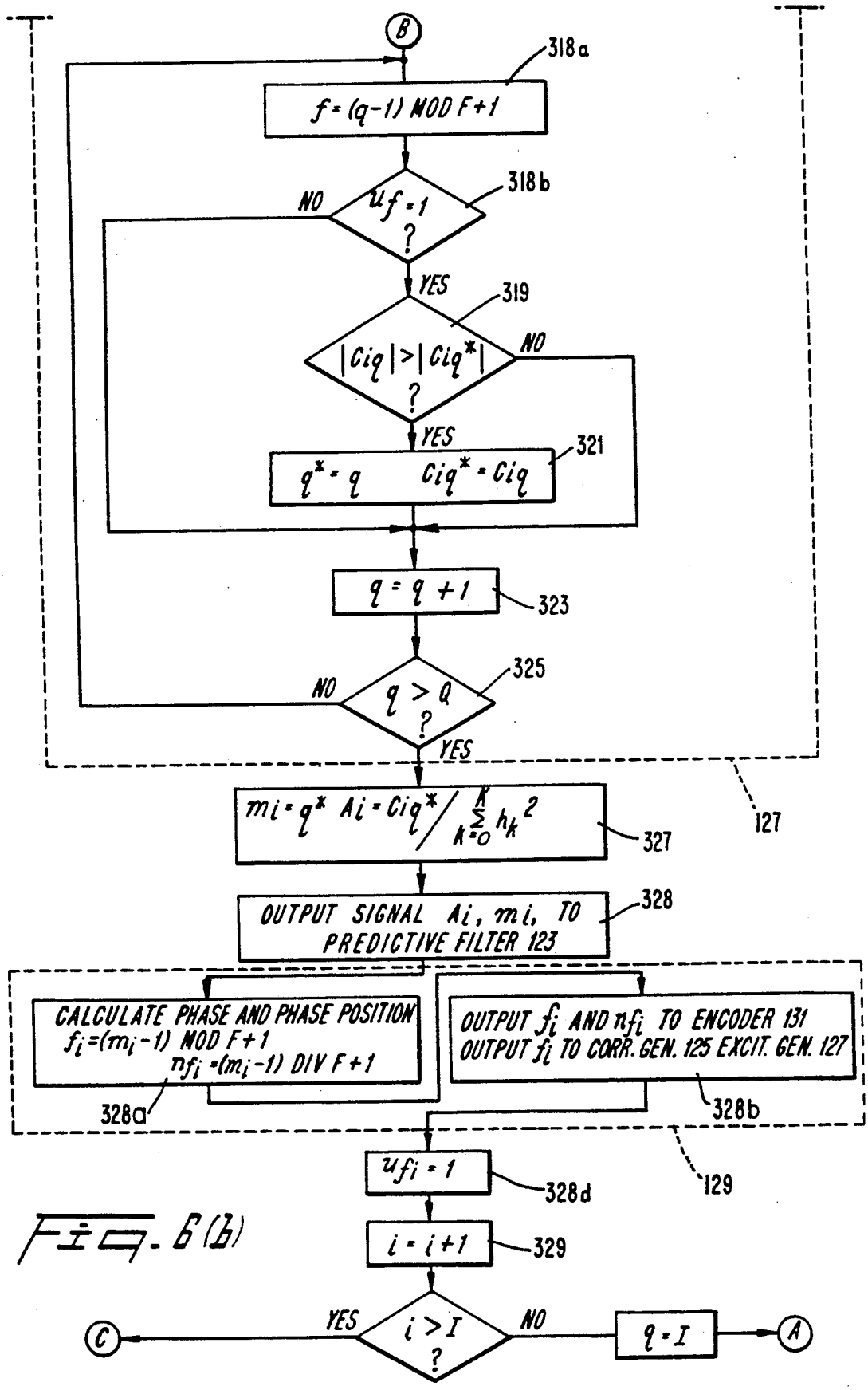

FIGS. 6(*a*) and 6(*b*) illustrate a flow chart which constitutes the flow chart illustrated in FIG. 3 of U.S. Pat. No. 4,472,832 which has been modified to include the phase limitation. Introduced between the blocks 327 and 329 (in place of block 328), which concern the calculation of the output signal $m_p$, $A_{mp}$ of the phase generator 129 and recitation of position index p, is a block 328*a* which concerns the calculations to be carried out in the phase generator, and thereafter a block 328*b* which concerns the application of an output signal on the coder 131 and the generators 125 and 127. $f_p$ and $n_{fp}$ are calculated in accordance with the above relationship (1). There is then carried out in the generators 125 and 127 a vector allocation $$u_{fi}=1$$

which is used when testing the obtained q-value=q* which gave the maximum value $\alpha_m/\phi_{mm}$ with the intention of ascertaining whether a corresponding pulse position gives a phase which is occupied or vacant. This test is carried in blocks 308*a*, 308*b*, 308*c* (between the blocks 307 and 309) and in the blocks 318*a*, 318*b* (between the blocks 317, 319). The instructions given by the blocks 308*a*, *b* and *c* are carried out in the correlation generator 125, whereas the instructions given by the blocks 318*a*, *b* are carried out in the excitation generator 127.

Firstly the signal f, i.e. the phase, is calculated from the index q in accordance with the aforegoing, whereafter a test is carried out to ascertain whether the vector position for the phase f in the vector $u_f$ is equal to 1. If $u_f=1$, which implies that the phase is occupied for precisely this index $q^*$, no correlation-calculations are carried out in accordance with the instruction from block 309 and similarly the comparisons in block 319. On the other hand, when $u_f=0$ this indicates a vacant phase and the subsequent calculations are carried out as earlier.

The occupied phases shall remain during all calculated sequencies relating to a full frame interval, but shall be vacant at the beginning of a new frame interval. Consequently, subsequent to block 307 the vector $u_i$ is set to zero prior to each new frame analysis.

When coding the positions $m_p$ for the various excitation pulses within a frame, both the phase position $n_{fp}$ and the phase $f_p$ shall be coded. Coding of the positions is thus divided up into two separate code words having mutually different significance. In this case, the bits in the code words obtain mutually different significance, and consequently the sensitivity to bit-error will also be different. This dissimilarity is advantageous with regard to error correction or error detection channel-coding.

The aforedescribed limitation in the positioning of the excitation pulses means that coding of the pulse positions takes place at a lower bit-rate than when coding the positions in multi-pulse without said limitation. This also means that the search algorithm will be less complex than without this limitation. Admittedly, the inventive method involves certain limitations when positioning the pulses. A precise pulse position is not always possible, however, this limitation shall be weighed against the aforesaid advantages.

The inventive method has been described in the aforegoing with reference to a speech coder in which positioning of the excitation pulses is carried out one pulse at a time until a frame interval has been filled. Another type of speech coder described in EP-A-195 487 operates with positioning of a pulse pattern in which the time distance $t_a$ between the pulses is constant instead of variable. The inventive method can also be applied with a speech coder of this kind. The forbidden positions in a frame therewith coincide with the positions of the pulses in a pulse pattern.

While a particular embodiment of the present invention has been described and illustrated, it should be understood that the invention is not limited thereto since modifications may be made by persons skilled in the art.

The present application contemplates any and all modifications that fall within the spirit and scope of the underlying invention disclosed and claimed herein.

I claim:

1. A method for positioning excitation pulses for a linear predictive coder and for coding positioning information wherein a synthesized speech signal is formed from an original speech signal, comprising:

(a) determining a number of predictive parameters which characterize said original speech signal within a time frame interval;

(b) calculating a residual signal representing an error between said original speech signal and said synthesized speech signal within said frame interval and generating an array of excitation pulses within said frame interval based on said residual signal and said predictive parameters;

(c) generating a weighted, speech-representative signal $Y_n$ by weighting said residual signal with said predictive parameters;

(d) generating a weighted, synthesized speech signal $\hat{Y}_n$ by weighting a representative signal which represents an amplitude and a time position of one of said excitation pulses with said predictive parameters;

(e) correlating for each of a number of modification stages i said weighted speech-representative signal $Y_n$ with said weighted synthesized speech signal $Y_n$ to determine a difference signal for each of said stages;

(f) determining for each of said stages a candidate for an excitation pulse representing an amplitude $A_i$ and a time position $m_i$ from said correlation of that stage, determining the minimum value of said difference signal among the difference signals for all candidates and selecting the candidate which corresponds to said minimum value to obtain the amplitude $A_{mp}$ and the time position $m_p$ for one of said excitation pulses, and repeating the pulse candidate determination procedure for a desired number of excitation pulses in a frame disregarding excitation pulses determined in previous modification stages;

(g) dividing a total number of possible time positions n for excitation pulses within said time frame into a number of phase positions $n_f$, each phase position including a number of phases f such that $n=n_fF+f$, where F is a total number of phases f in a particular phase position $n_f$;

(h) determining according to steps (d) through (f) an amplitude and a time position of a first and subsequent excitation pulses among time positions n having corresponding phases in each phase position but not occupied by time positions of preceding excitation pulses until a preset number of excitation pulses determined within said time frame interval have been positioned;

(i) coding each determined phase position $n_f$ separately to form separate code words; and (j) coding said determined phases together to form a single code word.

2. A method according to claim 1, wherein a phase $f_p$ and phase position $n_{fp}$ corresponding to an amplitude and time position $m_p$ determined for a particular excitation pulse p are calculated in accordance with the relationship $$n_{fp}=(m_p-1)\ \mathrm{Mod}\ F+1$$

$$f_p=(m_p-1)\ \mathrm{Div}\ F+1$$

wherein only a value of said phase $f_p$ in all phase positions $n_f$ within said time frame interval determines which time position of an excitation pulse following said particular excitation pulse p shall be forbidden and wherein this procedure is repeated for each excitation pulse until a desired number of excitation pulses has been obtained within the frame.

3. A method according to claim 2, further comprising:

generating a test vector from the number f of pulse phases within one phase position $n_f$ among a plurality of phase positions of a frame representing the state of availability of each phase within said time frame;

determining a phase in said test vector corresponding to the determined time position according to step (h);

determining whether said determined phase is available for a particular phase position based on said test vector;

if said determined phase is not available, determining if a phase of another phase position is available;

if said particular phase is available, successively executing steps (e) and (f) for a next, pulse position; and updating said test vector.

4. A method according to claim 1, further comprising:

generating a test vector from the number f of pulse phases within one phase position $n_f$ among a plurality of phase positions of a frame representing the state of availability of each phase within each phase position in said time frame;

determining a phase in said test vector corresponding to the determined time position according to step (h);

determining whether said determined phase is available for a particular phase position based on said test vector;

if said determined phase is not available, determining if a phase of another phase position is available;

if said particular phase is available, successively executing steps (e) and (f) for a next, pulse position; and updating said test vector.

* * * * *